US008297867B2

(12) United States Patent
Nasu et al.

(10) Patent No.: US 8,297,867 B2
(45) **Date of Patent: *Oct. 30, 2012**

(54) CONTAINER FOR VISCOUS COSMETIC

(75) Inventors: Mieko Nasu, Yokohama (JP); Takao Kishi, Tokyo (JP); Hiroshi Mizushima, Tokyo (JP)

(73) Assignees: Shiseido Co., Ltd., Tokyo (JP); Yoshino Kofyosho Co., Ltd., Tokyo (JP)

( * ) Notice: Subject to any disclaimer, the term of this patent is extended or adjusted under 35 U.S.C. 154(b) by 581 days.

This patent is subject to a terminal disclaimer.

(21) Appl. No.: 12/310,088

(22) PCT Filed: Aug. 2, 2007

(86) PCT No.: PCT/JP2007/065191

§ 371 (c)(1),
(2), (4) Date: Mar. 25, 2009

(87) PCT Pub. No.: WO2008/018367

PCT Pub. Date: Feb. 14, 2008

(65) Prior Publication Data

US 2009/0324321 A1 Dec. 31, 2009

(30) Foreign Application Priority Data

Aug. 11, 2006 (JP) ..... 2006-219850

(51) Int. Cl.

| | |
|---|---|
| ***B65D 83/00*** | (2006.01) |
| ***B43K 5/06*** | (2006.01) |
| ***B67D 7/60*** | (2010.01) |
| ***G01F 11/00*** | (2006.01) |
| ***B67D 3/00*** | (2006.01) |
| ***B67D 7/06*** | (2010.01) |

(52) U.S. Cl. ..... 401/175; 222/390; 222/396; 222/542

(58) Field of Classification Search ..... 401/175, 401/70, 68, 87, 75, 79; 222/386, 390, 412, 222/542, 568

See application file for complete search history.

(56) References Cited

U.S. PATENT DOCUMENTS

| | | | | |
|---|---|---|---|---|
| 1,458,281 | A * | 6/1923 | Everett | 401/175 |
| 1,728,298 | A * | 9/1929 | McLaughlin | 222/390 |
| 2,738,905 | A * | 3/1956 | Olson | 222/387 |
| 3,907,441 | A * | 9/1975 | Idec et al. | 401/75 |
| 4,506,810 | A | 3/1985 | Goncalves | |
| 5,547,302 | A * | 8/1996 | Dornbusch et al. | 401/172 |
| 5,733,058 | A * | 3/1998 | Hofmann | 401/70 |
| 5,772,347 | A | 6/1998 | Gueret | |
| 6,299,369 | B1 * | 10/2001 | Baines et al. | 401/75 |
| 2004/0007599 | A1 | 1/2004 | Tani | |
| 2010/0104345 | A1 * | 4/2010 | Nasu et al. | 401/68 |

FOREIGN PATENT DOCUMENTS

| | | |
|---|---|---|
| JP | 51-51943 | 4/1976 |
| JP | 58-30962 | 2/1983 |
| JP | 8-229461 | 9/1996 |
| JP | 2004-89687 | 3/2004 |
| JP | 2005-168745 | 6/2005 |
| JP | 2005-296676 | 10/2005 |

* cited by examiner

*Primary Examiner* — Dinh Q Nguyen
*Assistant Examiner* — Chee-Chong Lee
(74) *Attorney, Agent, or Firm* — Jordan and Hamburg LLP

(57) ABSTRACT

A container for a viscous cosmetic, in which upper and lower sections respectively positioned above and below an inner tray are air-tightly sealed off from each other so as to reduce leakage of a viscous cosmetic received in a receiving body from the upper section to the lower section.

8 Claims, 5 Drawing Sheets

CONTAINER FOR VISCOUS COSMETIC

BACKGROUND OF THE INVENTION

The present invention relates to a container for a viscous cosmetic including a receiving body for receiving a viscous cosmetic therein, and an inner tray for pushing out the viscous cosmetic.

BACKGROUND ART

As the related art, there is a container for a viscous cosmetic having no introduction mechanism of an inner tray. In case of using such a container for a viscous cosmetic, the amount of a viscous cosmetic received therein is reduced by using the viscous cosmetic, and the surface of the viscous cosmetic moves to a bottom surface of the container. For this reason, in such a case, to scoop up the viscous cosmetic with a finger, it is necessary to insert the finger to the bottom surface of the container, which is unsanitary in use.

In consideration of such a problem, there is a container for a viscous cosmetic capable of moving out a viscous cosmetic received in a receiving body upward by an inner tray, so that the surface of the viscous cosmetic received in the container is constantly placed at the upper section in the receiving body. As described above, it is possible to raise the upper surface of the viscous cosmetic, by moving out the viscous cosmetic by the inner tray, and thus sanitary use is possible without inserting a finger to the bottom of the receiving body.

Among containers provided with such an inner tray, as described in Patent Document 1, there is a container for a viscous cosmetic, in which an inner tray connected to a screw shaft by means of screw thread is placed in a cylindrical receiving body for receiving a viscous cosmetic such as a lip gloss, and in which the viscous cosmetic is sent out by moving out the inner tray by rotating the screw shaft. In such a container for a viscous cosmetic, when the receiving body and the inner tray are cylindrical and the screw shaft is rotated, particularly, when a torque of the screw shaft side of the inner tray is larger than a torque of the outer peripheral side of the inner tray, the inner tray is also rotated by rotating the screw shaft. When the inner tray is rotated by rotating the screw shaft, it is difficult to slide the inner tray in a vertical direction along the screw shaft in the receiving body. Accordingly, it is difficult to smoothly move out the inner tray.

In consideration of such a problem, as described in Patent Document 2, there is a container for a viscous cosmetic provided with a fitting piece on an inner peripheral surface of a receiving body not to rotate an inner tray in the receiving body, and provided with a recessed key groove capable of being fitted to the fitting piece on an outer peripheral surface of the inner tray, thereby installing the inner tray in the receiving body by fitting the key groove and the fitting piece to each other. Accordingly, the inner tray is slid in a vertical direction along the fitting piece of the receiving body, without rotating the inner tray even when the screw shaft is rotated. Therefore, it is possible to smoothly move out the inner tray.

Patent Document 1: Japanese Patent Application Laid-Open Publication No. 8-229461

Patent Document 2: Japanese Patent Application Laid-Open Publication No. 2005-168745

SUMMARY OF THE INVENTION

In the viscous cosmetic described in Patent Document 2, it is technically difficult in production to seal off a gap between the key groove provided on the outer peripheral surface of the inner tray and the fitting piece provided in the receiving body, and the upper section and the lower section of the inner tray easily communicate with each other through the fitted section between the key groove and the fitting piece. For this reason, the viscous cosmetic received on the upper section of the inner tray may leak out to the lower section through the key groove.

In the inventions described in Patent Document 1 and Patent Document 2, when the inner tray is mounted on the screw shaft, a gap may easily occur between the outer peripheral screw groove of the screw shaft and the inner peripheral screw groove of the inner tray. The outer peripheral screw groove formed on the screw shaft is continuously formed from the upper end to the lower end of the screw shaft. For this reason, a viscous cosmetic flows out along the outer peripheral screw groove of the screw shaft from the upper section of the inner tray for receiving the viscous cosmetic, passes through the screw thread connection section between the screw shaft and the inner tray, and reaches the lower section of the inner tray.

For this reason, it is difficult to seal off the gap between the inner tray and the screw shaft in the screw thread connection section, and thus the viscous cosmetic received on the upper section of the inner tray may leak out to the lower section of the inner tray. As described above, when the viscous cosmetic leaks out to the lower section of the inner tray, the leak-out viscous cosmetic cannot be used, which is not economical. In addition, loss of pressure applied by the inner tray occurs because of the leak, it may be difficult to move out the viscous cosmetic by moving the inner tray. When an easily volatilized viscous cosmetic is used, the viscous cosmetic may easily volatilize from the gap between the inner tray and the screw shaft. In addition, problems such as deterioration of the viscous cosmetic caused by inflow of outside air and mixing of various germs may occur.

The invention has been made to solve the aforementioned problems, and is to provide a container for a viscous cosmetic for sealing off a gap between an outer periphery of an inner tray and an outer peripheral surface of a receiving body, air-tightly sealing off the upper section and the lower section of the inner tray by sealing off a screw thread connection section between the screw shaft and the inner tray, preventing the viscous cosmetic received in the receiving body from leaking out from the upper section to the lower section, and smoothly moving out the inner tray by preventing the inner tray from rotating.

Means for Solving the Problem

To solve the aforementioned problems, the invention is provided a container for a viscous cosmetic including: a cylindrical receiving body that receives a viscous cosmetic therein; a lid body that is detachably connected to an upper end of the receiving body and air-tightly seals off communication between the inside of the receiving body and the outside air; a rotation body that is connected and placed at a lower end of the receiving body in a slidable manner; a screw shaft that is placed at the center of the rotation body coaxially with a shaft direction of the receiving body and is inserted into the receiving body; an inner tray that is connected to an outer periphery of the screw shaft by means of screw thread and, an outer periphery of which is placed so as to be slidable on and in intimate contact with an inner surface of the receiving body; and an annular packing that is placed in intimate contact with the surface on the screw thread connection section side of the inner tray, an inner peripheral end of which is placed so as to be in intimate contact with the outer periphery of the screw shaft, and is slidable along the screw shaft by sliding the inner tray.

The inner tray is installed with the outer periphery of the inner tray tightened toward the screw shaft by the inner peripheral surface of the receiving body. As described above, as a specific method to tighten the outer periphery of the inner tray toward the screw shaft, a diameter of the outer periphery of the inner tray is controlled equal to or slightly larger than a diameter of the inner peripheral surface of the receiving body, or a diameter of the inner peripheral surface of the receiving body is controlled equal to or slightly smaller than the outer periphery of the inner tray.

Accordingly, the outer periphery of the inner tray and the inner peripheral surface of the receiving body come in intimate contact with each other, and a torque on the outer peripheral side that is the receiving body side is larger than a torque on the screw thread connection section side of the inner tray. Therefore, the inner tray is slidable in an axial direction but is not rotatable in the receiving body, and it is possible to air-tightly seal off a gap between the outer periphery of the inner tray and the inner peripheral surface of the receiving body.

The screw shaft has a flat section having no screw groove formed continuously from the upper end to the lower end in the axial direction, and the flat section and the inner peripheral end surface of the packing are allowed to air-tightly come in intimate contact with each other. Accordingly, it is possible to seal off a gap between the inner peripheral end surface of the packing and the flat section of the screw shaft. The packing is placed in intimate contact with the screw thread connection section side of the inner tray as described above. Therefore, the upper section and the lower section on the screw thread connection section side of the inner tray are air-tightly sealed off. As described above, it is possible to seal off the upper section and the lower section on the outer peripheral side and the screw thread connection section side of the inner tray, and it is possible to smoothly slide the inner tray in a vertical direction along the screw shaft direction, without rotating the inner tray in the receiving body.

The packing may be placed in a packing presser having a sectional U shape, and the packing presser may be placed in intimate contact with the inner tray by fixing the packing pressing to the inner tray in a slidable manner. As described above, the packing is placed in intimate contact with the inner tray through the packing presser, thereby fixing the packing presser to the inner tray. Accordingly, the packing and the inner tray are prevented from being separated from each other, and thus it is possible to securely keep the intimate contact between the packing and the inner tray.

The packing may be placed in intimate contact with the inner tray in a slidable manner, and may be placed on the upper surface or the lower surface on the screw thread connection section side of the inner tray. The screw shaft may be formed integrally with or separately from the rotation body. The receiving body may be provided with an inner lid having one or more division holes, at the upper end thereof.

Advantage of the Invention

The invention is configured as described above, the outer periphery of the inner tray and the inner peripheral surface of the receiving body are in intimate contact with each other, and the torque on the receiving body side of the inner tray is larger than the torque on the screw shaft side. Accordingly, it is possible to place the inner tray in the slidable manner in the axial direction and in the non-rotatable manner in the receiving body, while air-tightly sealing off the gap between the outer periphery of the inner tray and the inner peripheral surface of the receiving body. The packing is placed in intimate contact with the screw thread connection section side of the inner tray, the screw shaft is provided with the flat section formed with no screw groove in the axial direction, and the inner peripheral surface of the packing and the flat section are allowed to come in intimate contact with each other. Accordingly, it is possible to seal off the gap between the inner tray and the screw shaft. Therefore, according to the aforementioned two effects, it is possible to smoothly move out the inner tray, with the upper section and the lower section air-tightly sealed off.

Embodiment 1

Figure 1:
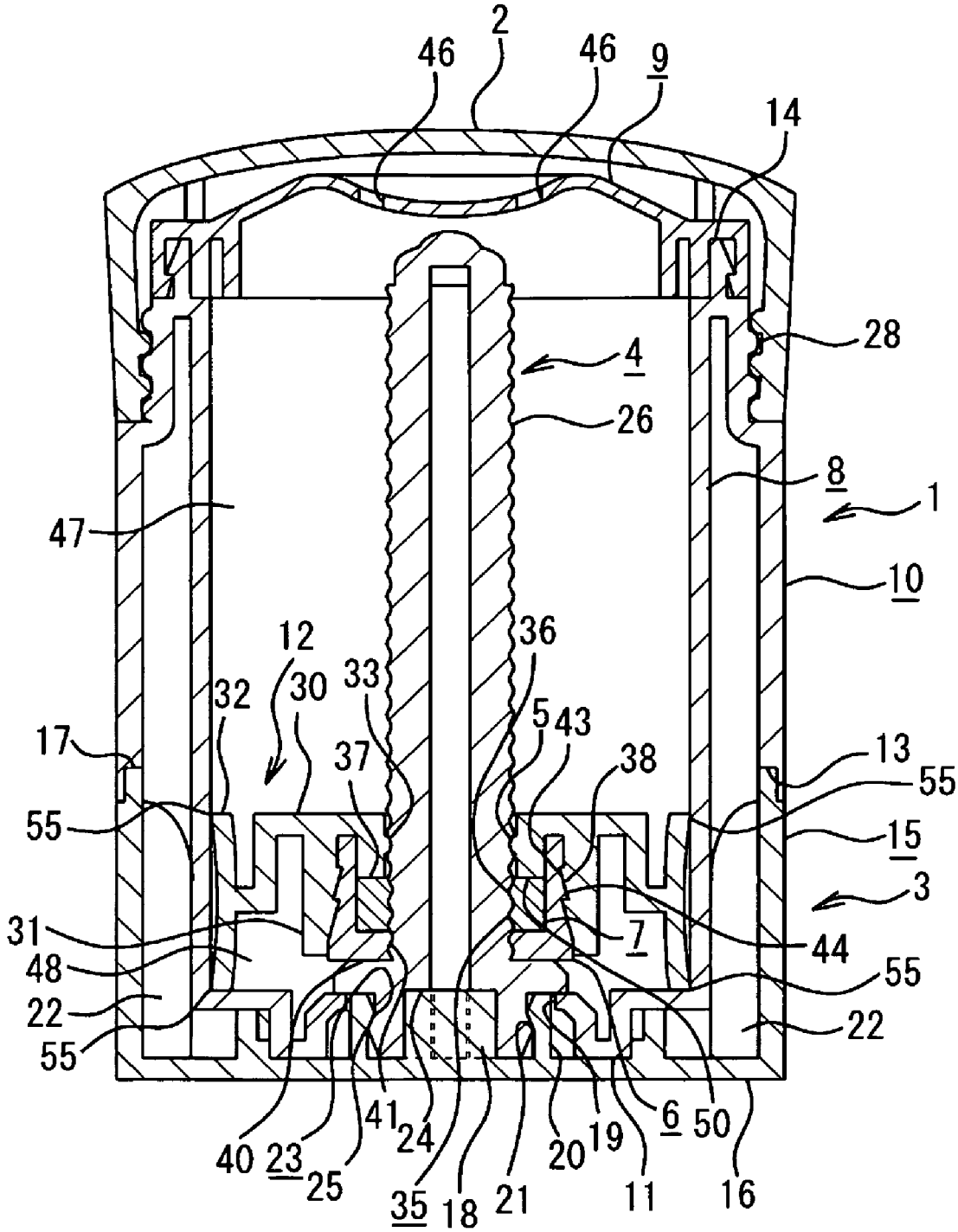
FIG. 1 is a sectional view illustrating a container for a viscous cosmetic according to Embodiment 1 of the invention.

Embodiment 1 of the invention will be described with reference to FIGS. 1 to 3. Reference Numeral 1 denotes a receiving body for receiving a viscous cosmetic therein. An inner lid 9 is fixed to the upper end of the receiving body 1. At the upper part of the inner lid 9, a lid body 2 for blocking communication between the inside of the receiving body 1 and the outside air is detachably connected to the receiving body 1. A cylindrical rotation body 3 is connected to the lower end side of the receiving body 1 in a rotatable manner about the receiving body 1, and a screw shaft 4 is fixed not to be rotated in an axial direction of the receiving body 1 and is placed in the receiving body 1 at the center of the rotation body 3. An inner tray 12 is installed on the screw shaft 4 by means of screw thread, and a packing 7 is placed in intimate contact with a lower surface 50 on a screw thread connection section 5 of the inner tray 12 through a packing presser 6.

Embodiment 1 will be described in more detail. The receiving body 1 is made of PP and has a cylindrical shape. As shown in FIG. 2, an inner peripheral wall 8 and an outer peripheral wall 10 are provided at a predetermined distance, and the upper end of the inner peripheral wall 8 and the upper end of the outer peripheral wall 10 are continued to each other. The inner peripheral wall 8 has a length in the axial direction larger than a length of the outer peripheral wall 10 in the axial direction, and has a bottom wall 11 having an opening section 19 formed at the center thereof, at the lower end of the inner peripheral wall 8. A screw groove 28 for screw thread connection to the lid body 2 is formed at the upper end of the outer peripheral wall 10, and a lower end section 13 for connecting the upper end of the rotation body 3 is formed in the inner peripheral surface of the lower end. An annular protruding section 14 for connecting the inner lid 9 is formed at the upper end of the receiving body 1 formed as described above.

Figure 2:
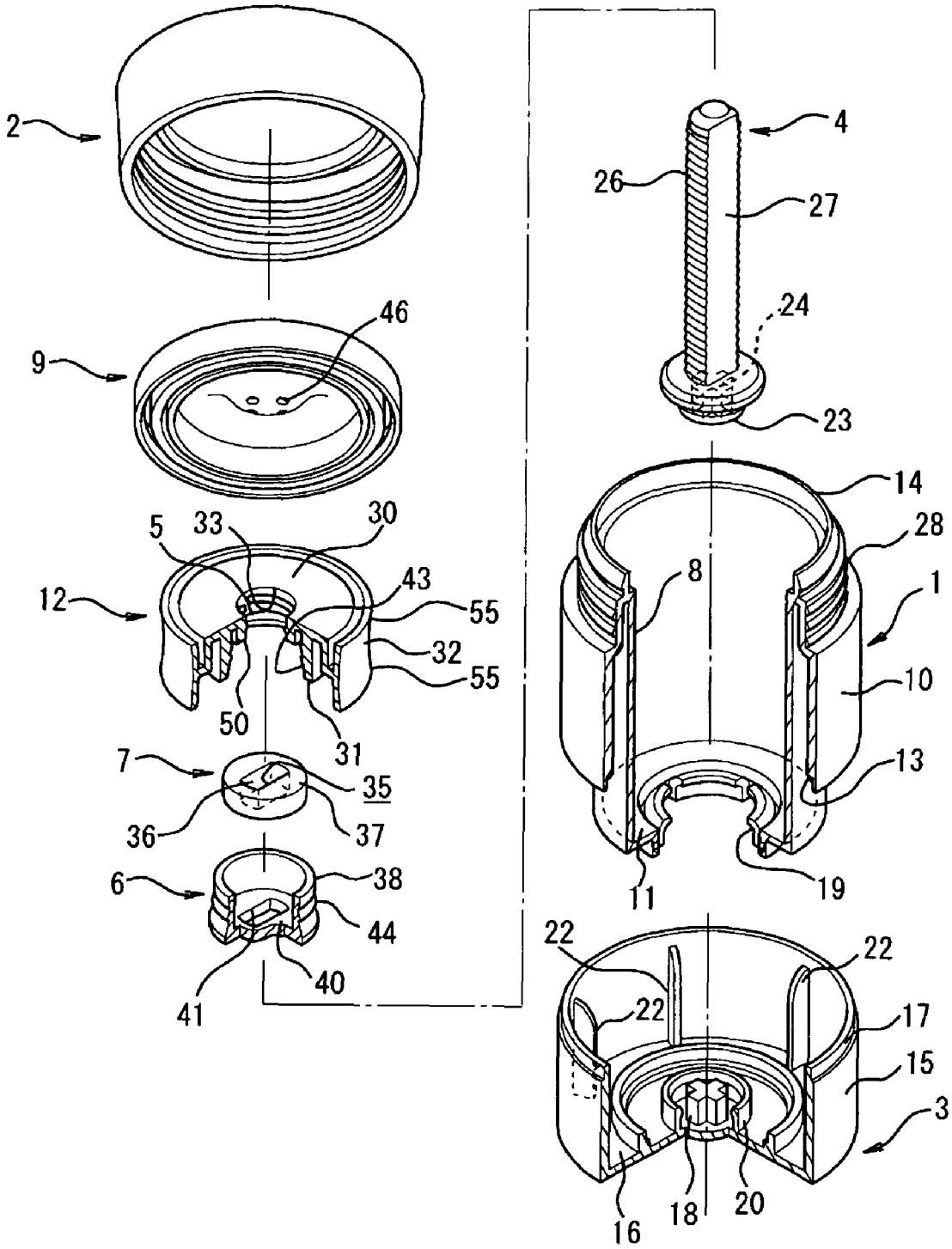
FIG. 2 is an exploded perspective view of Embodiment 1.
Figure 3:
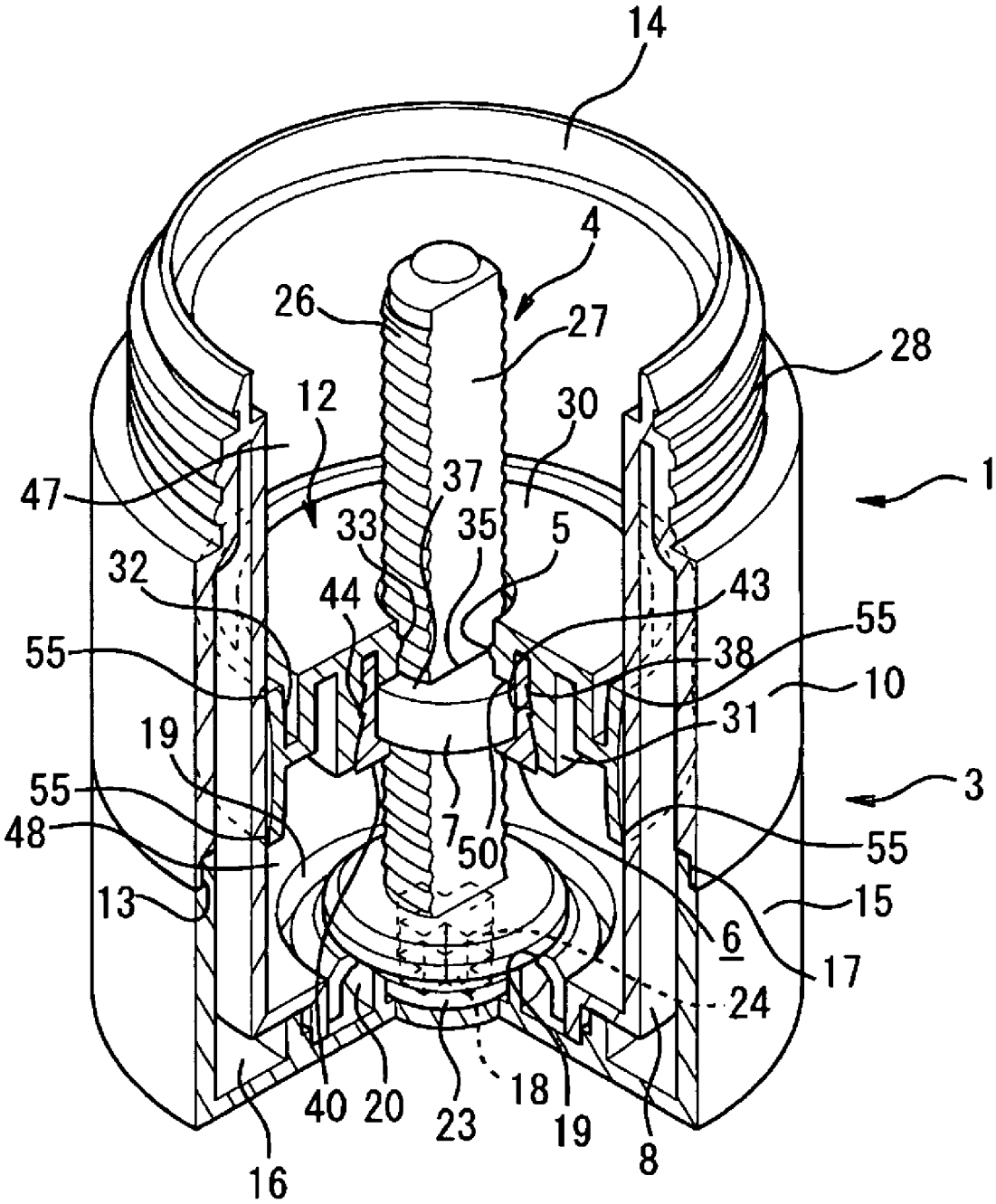
FIG. 3 is a partially cut away sectional view illustrating a state where a lid body and an inner lid are detached in Embodiment 1.

As shown in FIG. 3, a cylindrical and sectional U-shaped rotation body 3 is connected to the lower end of the receiving body 1. The rotation body 3 is made of PP and has a peripheral wall 15 and a bottom plate 16, as shown in FIG. 2. An outer diameter of the peripheral wall 15 is substantially equal to the outer peripheral wall 10 of the receiving body 1. An upper end section 17 capable of being fitted to the lower end section 13 of the receiving body 1 is provided at the upper end of the peripheral wall 15 in a peripheral direction. A cross-shaped fitting protruding section 18 for installing the screw shaft 4 in a non-rotatable manner is formed at the center of the bottom plate 16 of the rotation body 3, and an annular wall 20 is formed at the outer periphery of the fitting protruding section 18. As shown in FIG. 1, an engagement recessed section 21 is formed on the inner peripheral surface of the annular wall 20 in the peripheral direction. A plurality of ribs 22 protruding in the axial direction are provided on the inner peripheral surface of the rotation body 3 at a predetermined distance.

The inner peripheral wall 8 of the receiving body 1 is inserted into the rotation body 3 formed as described above, and the upper end section 17 of the rotation body 3 is allowed to come in intimate contact with the lower end section 13 of the receiving body 1, thereby installing the rotation body 3 at the lower end of the receiving body 1. The rotation body 3 is installed at the receiving body 1 as described above. Accordingly, as shown in FIG. 1, the lower surface of the bottom wall 11 of the receiving body 1 comes in intimate contact with the upper surface of the bottom plate 16 of the rotation body 3, the annular wall 20 and the fitting protruding section 18 provided on the bottom plate 16 of the rotation body 3 are placed in the opening section 19 of the bottom wall 11 of the receiving body 1. In this case, as shown in FIG. 1, since the rib 22 protruding in the rotation body 3 comes in intimate contact with the surface of the inner wall 8 of the receiving body 1, it is possible to stably place the inner wall 8 of the receiving body 1 in the rotation body 3. For this reason, it is possible to stably and smoothly rotate the rotation body 3 installed at the receiving body 1.

The screw shaft 4 made of PP shown in FIG. 1 is connected to the center of the bottom plate 16 of the rotation body 3 installed at the receiving body 1. That is, an annular connection section 23 capable of being inserted into the annular wall 20 of the rotation body 3 is provided at the lower end of the screw shaft 4, and a cross-shaped fitting recessed section 24 capable of being fitted to the fitting protruding section 18 of the rotation body 3 is provided in a recessed shape from the lower end of the connection section 23 inward. An annular engagement protruding section 25 capable of engaging with the engagement recessed section 21 provided at the inner periphery of the annular wall 20 of the rotation body 3 is formed on the outer peripheral surface of the connection section 23.

The engagement protruding section 25 of the connection section 23 is engaged with the engagement recessed section 21 of the annular wall 20 with the fitting protruding section 18 of the rotation body 3 inserted to the fitting recessed section 24 of the screw shaft 4, and thus it is possible to connect and fix the screw shaft 4 to the rotation body 3 in a non-rotatable manner. For this reason, when the rotation body 3 is rotated, the screw shaft 4 is also rotated by the rotation of the rotation body 3. As shown in FIG. 2, the screw shaft 4 is continuously provided with a screw groove formed section 26 on the outer peripheral surface thereof and a flat section 27 having no screw groove from the upper end and the lower end, in the axial direction. The flat section 27 is provided at two opposite parts of the screw shaft 4, and has a substantially oval shape in the sectional view.

As shown in FIG. 3, the screw shaft 4 installed at the rotation body 3 is connected to a substantially cylindrical inner tray 12 by means of screw thread. As shown in FIG. 2, the inner tray 12 is made of HDPE, and has an annular inner wall 31 formed on the lower surface of a plate-shaped upper wall 30. An annular outer wall 32 is provided at the outer periphery of the upper wall 30 at a predetermined distance from the upper wall 30. As shown in FIG. 1, the outer wall 32 has a shape protruding both widthwise side sections 55 outward by slightly bending the widthwise center thereof inward. As shown in FIG. 2, a circular hole section 33 is formed at the center of the upper wall 30, and an annular screw thread connection section 5 having a screw groove capable of being connected to the screw shaft 4 by means of screw thread is formed in the inner periphery of the hole section 33.

As shown in FIG. 1, the annular packing 7 is placed in intimate contact with the lower end of the screw thread connection section 5. The packing 7 is made of NBR having flexibility and elasticity, and has a substantially oval shape as shown in FIG. 2. A through-hole 35 is formed at the center thereof in a substantially oval shape. When the screw shaft 4 is inserted into and passed through the through-hole 35, an inner peripheral end surface 36 of the through-hole 35 is formed in intimate contact with the flat section 27 of the screw shaft 4. As shown in FIG. 1, the packing 7 is connected to and placed in the inner tray 12 through the sectional U-shaped packing presser 6.

That is, the packing presser 6 has an annular connection wall 38 and a flat bottom section 40 as shown in FIG. 2, and a substantially oval insertion hole 41 capable of inserting and passing the screw shaft 4 is formed at the center of the bottom section 40. When the screw shaft 4 is inserted and passed through the insertion hole 41, the outer peripheral surface of the screw shaft 4 comes in contact with the inner peripheral end surface of the insertion hole 41. The packing 7 formed as described above is capable of being received in the packing presser 6. When the packing 7 is received in the packing presser 6, the outer peripheral surface of the packing 7 comes in intimate contact with the inner peripheral surface of the connection wall 38 of the packing presser 6.

The packing presser 6 formed as described above is connected to the inside of the inner wall 31 of the inner tray 12, and an annular protruding section 44 capable of being fitted to an annular receiving section 43 formed on the inner peripheral surface of the inner wall 31 of the inner tray 12 is provided on the outer peripheral surface of the connection wall 38 of the packing presser 6. The annular protruding section 44 is fitted to the fitting receiving section of the inner wall 31 of the inner tray 12 and the packing presser 6 is placed in the inner wall 31 of the inner tray 12, thereby connecting the packing presser 6 to the inner tray 12 in a rotatable manner and in a non-detachable manner.

When the packing presser 6 receiving the packing 7 as described above is connected to the inner tray 12, the packing 7 is elastically deformed and the upper end section 37 thereof comes in intimate contact with the lower surface 50 of the screw thread connection section 5 of the inner tray 12. As described above, since the inner peripheral surface of the through-hole 35 of the packing 7 comes in intimate contact with the flat section 27 of the screw shaft 4, the packing 7 comes in intimate contact with the inner tray 12 and the screw shaft 4 on the inner peripheral end surfaces of the through-hole 35 and the upper end surface 37. Accordingly, it is possible to air-tightly seal off the upper section 47 and the lower section 48 of the inner tray 12 at the screw thread connection section 5 between the inner tray 12 and the screw thread 4. As described above, since the packing 7 is placed in intimate contact with the inner tray 12 through the packing presser 6 to connect and fix the packing presser 6 to the inner tray 12, the packing 7 is not detached from the inner tray 12 and it is possible to securely keep the intimate contact between the packing 7 and the inner tray 12.

The plate-shaped inner lid 9 is connected and fixed to the annular protruding section 14 provided at the upper end of the receiving body 1. The inner lid 9 is provided with four division holes 46 for ejecting a viscous cosmetic received in the receiving body 1. As shown in FIG. 1, the lid body 2, the lower end of which is detachably connected to the outer peripheral wall 10 of the receiving body 1, is placed at the upper part of the inner lid 9, and it is possible to block communication between the inside of the receiving body 1 and the outside air at the keeping time by the connection of the lid body 2. At the using time, the lid body 2 is separated from the receiving body 1.

In the container for a viscous cosmetic according to the embodiment configured as described above, first, the upper section 47 of the inner tray 12 in the receiving body 1 is filled with a viscous cosmetic. In the present embodiment and the following embodiments, a liquid cream is used as the viscous cosmetic. In the other embodiments, a cleansing cream, a cream foundation, a lip gloss, a base for a lipstick, a liquid lipstick, and the other viscous cosmetic may be used. In such a state, the rotation body 3 is rotated in one direction while keeping the receiving body 1, thereby rotating the screw shaft 4 installed at the rotation body 3 in the same direction by the rotation of the rotation body 3.

The inner tray 12 connected to the screw shaft 4 by means of screw thread is moved up along the screw shaft 4 by the rotation of the screw shaft 4. In this case, the outer wall 32 of the inner tray 12 is tightened toward the screw thread connection section 5 by the inner peripheral wall 8 of the receiving body 1 by controlling the outer diameter of the inner tray 12. Accordingly, the both widthwise side sections 55 protruding outward in the outer wall 32 of the inner tray 12 come in intimate contact with the inner peripheral surface of the inner peripheral wall 8 of the receiving body 1 continuously in the peripheral direction. As described above, since the outer wall 32 of the inner tray 12 is tightened by the inner peripheral surface of the inner peripheral wall 8 of the receiving body 1, a torque on the screw thread connection section 5 side of the inner tray 12 can be larger than a torque on the outer wall 32 side.

Values of the torques were actually measured by a torque meter (manufactured by IMADA Co., Ltd). As a result, when a force representing a tightening degree to the inner tray 12 is 23.5 N, the torque on the screw thread connection section 5 side was 15.5 Ncm and the torque on the outer wall 32 side was 56.7 Ncm. As described above, the outer wall 32 of the inner tray 12 is tightened toward the screw thread connection section 5 by the inner peripheral wall 8 of the receiving body 1, and the torque on the outer wall 32 is larger than the torque on the screw thread connection section 5 side of the inner tray 12. In this state, when the screw shaft 4 is rotated through the rotation body 3, the inner tray 12 installed at the screw shaft 4 is not rotated in the receiving body 1 and is slidable in the axial direction along the screw shaft 4. Accordingly, it is possible to smoothly slide the inner tray 12 in the vertical direction, in the state where the outer wall 32 of the inner tray 12 and the inner peripheral wall 8 of the receiving body 1 come in intimate contact with each other through out the whole periphery, by rotating the rotation body 3.

As described above, the inner tray 12 is slid in the vertical direction, thereby also sliding the packing presser 6 connected to the inner tray 12 and the packing 7 received in the packing presser 6 along the screw shaft 4 at the same time. When the rotation body 3 is rotated, the inner tray 12 is not rotated and is slid in the vertical direction. However, since the packing presser 6 and the packing 7 are rotatably connected to the inner tray 12, they are rotated by the rotation of the screw shaft 4.

In this case, since the upper end surface 37 of the packing 7 comes in intimate contact with the lower surface 50 of the inner wall 31 of the inner tray 12 and the inner peripheral end surface 36 of the through-hole 35 comes in intimate contact with the flat section 27 of the screw shaft 4, it is possible to slide the inner tray 12 while air-tightly sealing off the upper section 47 and the lower section 48 of the inner tray 12, at the screw thread connection section 5 of the inner tray 12. Since the outer wall 32 of the inner tray 12 and the inner peripheral wall 8 of the receiving body 1 come in intimate contact with each other through out the whole periphery as described above, it is possible to slide the inner tray 12 while air-tightly sealing off the upper section 47 and the lower section 48, on the outer wall 32 side of the inner tray 12. Accordingly, it is possible to air-tightly seal off the upper section 47 and the lower section 48 of the inner tray 12 on both sides of the outer wall 32 side and the screw thread connection section 5 side of the inner tray 12, and thus it is possible to securely prevent a viscous cosmetic on the upper section 47 side of the inner tray 12 from leaking out to the lower section 48.

In such a state, the inner tray 12 is moved up by rotating the rotation body 3 in one direction, thereby ejecting the viscous cosmetic received on the upper section 47 of the inner tray 12 from the division holes 46 of the inner lid 9. At this time, a user can eject only a necessary amount of the viscous cosmetic from the division holes 46 by controlling the rotation of the rotation body 3. At the last finishing time of the using, since the upper wall 30 of the inner tray 12 comes in intimate contact with the inner surface of the inner lid 9, it is possible to minimize the remaining amount of the viscous cosmetic. Accordingly, it is possible to economically use the viscous cosmetic without waste.

When the inner lid 9 is placed at the upper end of the receiving body 1 as described above, a user scoops up and uses only the viscous cosmetic ejected from the division holes 46 to the surface of the inner lid 9. Accordingly, it is not necessary to insert a finger in the receiving body 1, and thus it is possible to prevent pollution of the viscous cosmetic received in the receiving body 1. Therefore, it is possible to sanitarily use the viscous cosmetic.

In the present embodiment and the following Embodiment 2 and Embodiment 3, the rotation body 3 and the screw shaft 4 are formed separately from each other. However, in the other embodiments, the rotation body 3 and the screw shaft 4 can be formed integrally with each other.

Embodiment 2

Figure 4:
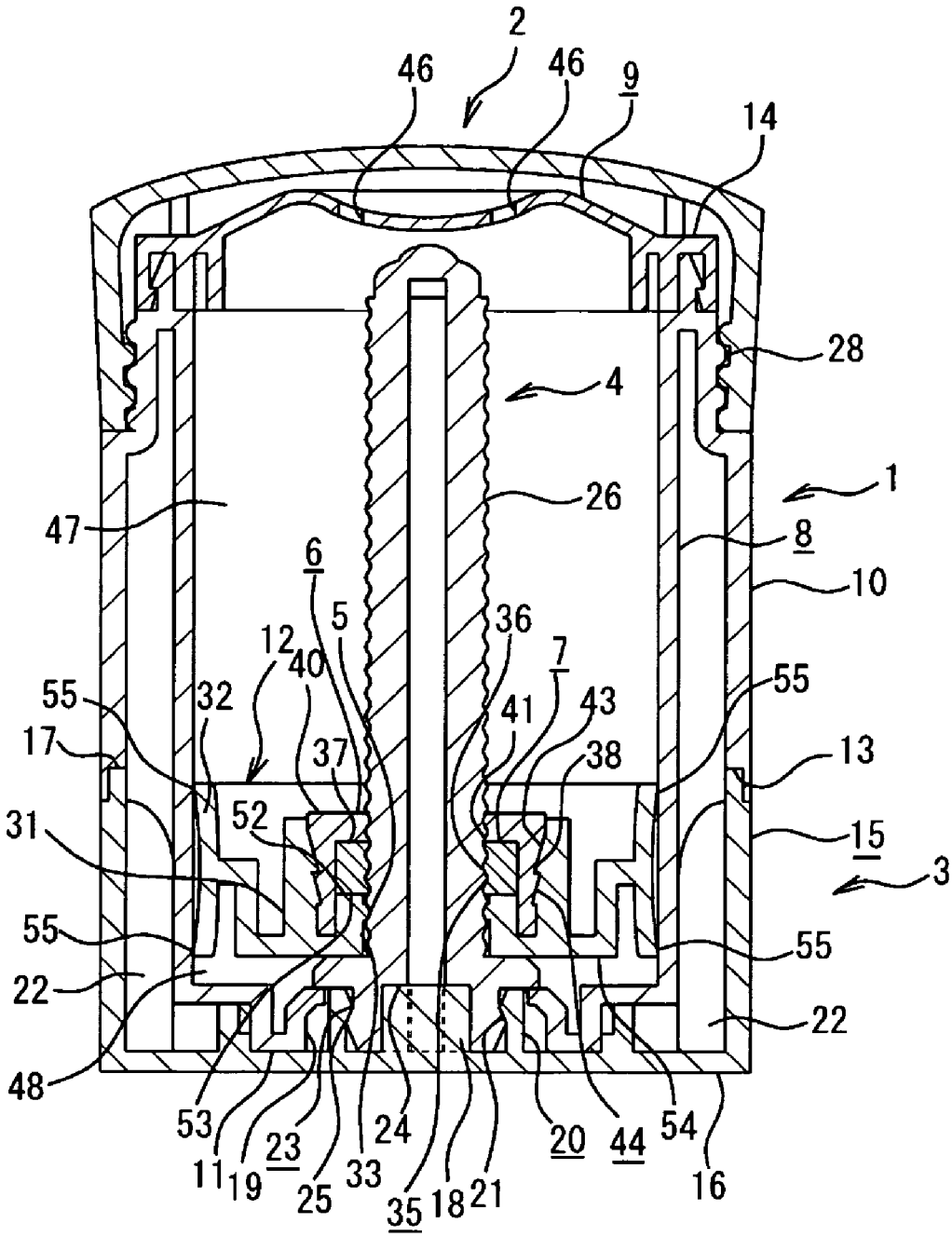
FIG. 4 is a sectional view illustrating a container for a viscous cosmetic according to Embodiment 2 of the invention.

In Embodiment 1, the packing presser 6 receiving the packing 7 is fixed to the lower surface 50 side of the inner tray 12. However, in Embodiment 2 of the invention, as shown in FIG. 4, the annular inner wall 31 protrudes on the upper surface of the bottom side wall 54 of the inner tray 12, the annular outer wall 32 is provided at the upper surface periphery of the bottom side wall 54, the packing presser 6 receiving the packing 7 is connected and fixed to the inner wall 31 of the inner tray 12, and the lower end surface 53 of the packing 7 is placed in intimate contact with the upper surface 52 of the screw thread connection section 5 of the inner tray 12.

The through-hole 35 of the packing 7 is formed substantially in the same size as that of the insertion hole 4 of the packing presser 6. Accordingly, when the packing presser 6 receiving the packing 7 is installed at the inner tray 12, the whole upper end surface 37 of the packing 7 is covered with the bottom section 40 of the packing presser 6. Accordingly, when a viscous cosmetic is received in the receiving body 1, the viscous cosmetic comes in contact with the packing presser 6 installed at the inner tray 12, but hardly comes in contact with the upper end surface 37 of the packing 7 received in the packing presser 6. For this reason, it is possible to avoid a problem such as swelling of the packing 7 caused by the contact of the viscous cosmetic.

Embodiment 3

Figure 5:
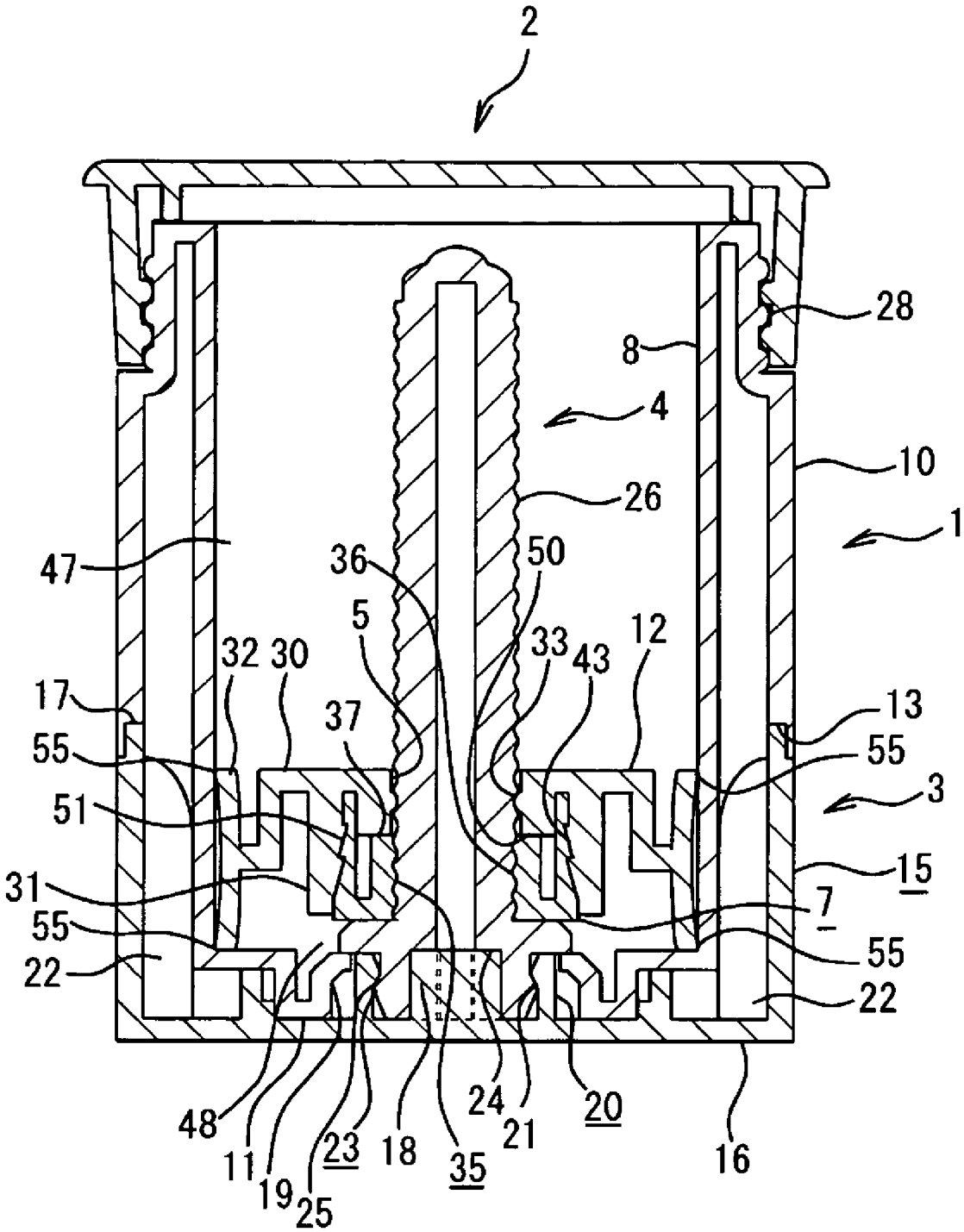
FIG. 5 is a sectional view illustrating a container for a viscous cosmetic according to Embodiment 3 of the invention.

In Embodiments 1 and 2, the packing 7 made of NBR is placed in intimate contact with the upper surface 52 or the lower surface 50 of the inner tray 12 through the packing presser 6. However, in Embodiment 3 of the invention, as shown in FIG. 5, the packing 7 made of LDPE comes directly in intimate contact with the inner tray 12 without using the packing presser 6.

Embodiment 3 will be described in more detail. The packing 7 according to the present embodiment is formed in a cylindrical shape, the through-hole 35 is formed at the center of the packing 7, and the inner peripheral end surface 36 of the through-hole 35 is placed in intimate contact with the flat section 27 of the screw shaft 4. As shown in FIG. 5, the packing 7 is connected to the inside of the inner wall 31 protruding on the lower surface of the upper wall 30 of the inner tray 12, and an annular protruding section 51 capable of engaging with the annular receiving section 43 formed on the inner wall 31 is provided on the outer peripheral surface thereof.

The packing 7 formed as described above is installed in the inner wall 31 of the inner tray 12 with the annular receiving section 43 and the annular protruding section 51 engaging with each other, and thus it is possible to rotatably connect the packing 7 to the inner tray 12. Accordingly, the inner tray 12 is not rotated and is moved in the vertical direction by rotating the screw shaft 4, but the packing 7 is slid while rotating together with the screw shaft 4 as being connected to the inner tray 12.

Since the upper end surface 37 of the packing 7 is fixed to the lower surface 50 of the screw thread connection section 5 of the inner tray 12 and the inner peripheral surface of the through-hole 35 comes in intimate contact with the flat section 27 of the screw shaft 4 as described above, it is possible to air-tightly seal off the upper section 47 and the lower section 48 in the screw thread connection section 5 of the inner tray 12. As described above, the packing 7 is directly connected to the inner tray 12 without using the packing presser 6, thereby reducing the number of components. Therefore, it is possible to obtain inexpensive products.

In Embodiments 1 and 2, the inner lid 9 is provided at the upper end of the receiving body 1. However, in Embodiment 3, the inner lid 9 is not provided. Accordingly, the number of components is reduced, and thus it is possible to produce inexpensive products. In addition, it is possible to check the remaining amount of the viscous cosmetic received in the receiving body 1 with the naked eye, and it is possible to keep the surface of the viscous cosmetic constantly at a regular level by moving out the inner tray 12 according to reduction of the viscous cosmetic.

The invention claimed is:

1. A container for a viscous cosmetic comprising:

a cylindrical receiving body that receives a viscous cosmetic therein;

a lid body that is detachably connected to an upper end of the receiving body and air-tightly seals off communication between the inside of the receiving body and the outside air;

a rotation body that is connected and placed at a lower end of the receiving body in a rotatable manner;

a screw shaft that is placed at the center of the rotation body coaxially with a shaft direction of the receiving body and is inserted into the receiving body;

an inner tray that defines an upper and a lower section and that is connected to an outer periphery of the screw shaft by means of screw thread and, an outer periphery of which is placed so as to be slidable on and in intimate contact with an inner surface of the receiving body; and an annular packing that is placed in intimate contact with the surface on the screw thread connection section side of the inner tray, an inner peripheral end of which is placed so as to be in intimate contact with the outer periphery of the screw shaft and a outer peripheral end of which is placed so as to be in intimate contact with an inner surface of a packing presser, the packing presser having an outer surface in contact with an inner tray wall of the inner tray that is positioned between the outer periphery of the screw shaft and the outer periphery of the inner tray, and the annular packing being slidable along the screw shaft by sliding the inner tray, wherein the inner tray is installed and is tightened toward the screw shaft with the outer periphery thereof placed in intimate contact with the outer periphery, a torque on the outer peripheral side placed in intimate contact with the receiving body is larger than a torque on the screw thread section side of the inner tray with the inner peripheral surface placed in intimate contact with the outer periphery of the inner tray, the inner tray is slidable in an axial direction with the inner tray hardly rotated in the receiving body, the screw shaft has a flat section having no screw groove in the axial direction, and the upper section and the lower section are air-tightly sealed off by allowing the flat section and the inner peripheral end surface of the packing be in intimate contact with each other.

2. The container for a viscous cosmetic according to claim 1, wherein the packing is placed in a packing presser having a sectional U shape, and the packing presser is placed in intimate contact with the inner tray by fixing the packing presser to the inner tray in a slidable manner.

3. The container for a viscous cosmetic according to claim 1, wherein the packing is placed in intimate contact with the inner tray in a slidable manner.

4. The container for a viscous cosmetic according to any one of claims 1 to 3, wherein the packing is placed on the upper surface on the screw thread connection section side of the inner tray.

5. The container for a viscous cosmetic according to any one of claims 1 to 3, wherein the packing is on the lower surface on the screw thread connection section side of the inner tray.

6. The container for a viscous cosmetic according to claim 1, wherein the screw shift is formed integrally with the rotation body.

7. The container for a viscous cosmetic according to claim 1, wherein the screw shaft is formed separately from the rotation body.

8. The container for a viscous cosmetic according to claim 1, wherein the receiving body is provided with an inner lid having one or more division holes, at the upper end thereof.

* * * * *

UNITED STATES PATENT AND TRADEMARK OFFICE

CERTIFICATE OF CORRECTION

PATENT NO. : 8,297,867 B2
APPLICATION NO. : 12/310088
DATED : October 30, 2012
INVENTOR(S) : Mieko Nasu et al.

It is certified that error appears in the above-identified patent and that said Letters Patent is hereby corrected as shown below:

Title Page

Please correct the name of the Assignee as follows:

from: (73) "Shiseido Co., Ltd., Tokyo (JP); Yoshino Kofyosho Co., Ltd., Tokyo (JP)"

to: (73) --Shiseido Co., Ltd., Tokyo (JP); Yoshino Kogyosho Co., Ltd., Tokyo (JP)--

Signed and Sealed this
Nineteenth Day of March, 2013

Teresa Stanek Rea
*Acting Director of the United States Patent and Trademark Office*